US008934638B2

(12) United States Patent
Kimura

(10) Patent No.: US 8,934,638 B2
(45) Date of Patent: Jan. 13, 2015

(54) NOISE CANCELING HEADPHONE

(75) Inventor: Tominori Kimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 477 days.

(21) Appl. No.: 13/146,948

(22) PCT Filed: Nov. 26, 2009

(86) PCT No.: PCT/JP2009/070266

§ 371 (c)(1),
(2), (4) Date: Jul. 29, 2011

(87) PCT Pub. No.: WO2010/089934

PCT Pub. Date: Aug. 12, 2010

(65) Prior Publication Data

US 2011/0286607 A1 Nov. 24, 2011

(30) Foreign Application Priority Data

Feb. 4, 2009 (JP) ..... 2009-023354

(51) Int. Cl.

| | |
|---|---|
| ***H04R 5/033*** | (2006.01) |
| ***G10K 11/178*** | (2006.01) |
| ***H04R 1/10*** | (2006.01) |

(52) U.S. Cl.

CPC ..... *G10K 11/1788* (2013.01); *H04R 1/1083* (2013.01); *G10K 2210/1081* (2013.01); *G10K 2210/3027* (2013.01)

USPC ..... 381/71.6; 381/370; 381/372; 381/74

(58) Field of Classification Search

USPC ..... 381/71.1–71.3, 71.6, 72–74, 370, 372, 381/374, 382

See application file for complete search history.

(56) References Cited

U.S. PATENT DOCUMENTS

| | | | | |
|---|---|---|---|---|
| 3,968,334 | A * | 7/1976 | Padilla | 73/585 |
| 2005/0220318 | A1* | 10/2005 | Han | 381/371 |
| 2006/0067538 | A1* | 3/2006 | Huang | 381/71.1 |
| 2007/0253569 | A1 | 11/2007 | Bose | |
| 2009/0175463 | A1* | 7/2009 | Lee et al. | 381/71.6 |

FOREIGN PATENT DOCUMENTS

| | | |
|---|---|---|
| JP | 2000-059876 | 2/2000 |
| JP | 2008-116782 | 5/2008 |
| JP | 2008-19342 | 8/2008 |
| WO | 2007/129003 | 11/2007 |

* cited by examiner

*Primary Examiner* — Duc Nguyen
*Assistant Examiner* — George Monikang
(74) *Attorney, Agent, or Firm* — Whitham Curtis Christofferson & Cook, PC

(57) ABSTRACT

Noise canceling headphones designed so that external noise coming from all directions can be effectively concerned by means of a canceling sound before being heard by a user. These feed-forward noise canceling headphones use noise canceling headphones (10), each of which comprises an air chamber (8) formed from a space that is sealed by a member covering the outer circumference of the housing and provided more outward than a front air chamber (7), and wherein the sound-wave introducing part of a microphone (2) is inside the air chamber (8).

10 Claims, 2 Drawing Sheets

NOISE CANCELING HEADPHONE

TECHNICAL FIELD

The present invention relates to a feed-forward noise canceling headphone, and specifically, a noise canceling headphone which can effectively cancel directional external noise by deploying an introducing part of a microphone which collects the external noise in a sealed space provided outside a front air chamber.

BACKGROUND ART

In a noise canceling headphone, a microphone that collects external noise is disposed in a part of a housing, a signal (canceling signal) that cancels the external noise is generated in response to the external noise collected by the microphone, a speaker unit is driven in response to the generated canceling signal to output a canceling sound, and the external noise is canceled by the canceling sound.

In a feed-forward noise canceling headphone, a microphone that collects external noise is disposed outside a front air chamber. Since a sound output from a speaker unit (a reproduced sound such as a musical sound and a canceling sound) is not fed back by the microphone, the canceling sound does not adversely influence frequency characteristics during use for playing music. Accordingly, the feed-forward noise canceling headphone is suitable for reproducing a high quality-musical sound. The above-mentioned "front air chamber" indicates a space surrounded by an ear pad and covered by the side of a user's head to communicate with an ear canal when the headphone is in use.

Noise canceling headphones having various shapes are known. Included are noise canceling headphones of an on-ear type (supra-concha type) and an ear-muff type (circum-aural type) except for an earplug type (canal type) each of which has a sound-wave introducing part of the microphone facing an external space of a housing of the headphone. Since the sound-wave introducing part of the microphone, therefore, tends to be directly subjected to wind and rain under a high-wind condition and a rainfall condition, noise caused by the above-explained situation is collected too highly to cancel the noise. Depending on a positional relationship between a noise source and the microphone, the noise may reach the user's ears through a housing before reaching the microphone. In that case, the noise to be canceled is heard before outputting a canceling sound, and thereby a canceling effect cannot be expected. Furthermore, there is concern that the canceling sound may accentuate the noise.

A noise canceling headphone for solving the above-described problems is known which effectively cancels noise without depending on the direction of a noise source by uniformly arranging a plurality of microphones on the circumference of an ear cup as a part of a housing. In addition, a noise canceling headphone is known which is designed so that a microphone disposed in a front air chamber collects noise that reaches the user's ears through a housing before being collected by an external microphone, and then a canceling sound that is not affected by the direction of a noise source is output, by combining a feedback system that includes a microphone in a front air chamber with the above-described feed-forward system (See Patent Document 1, for example).

[Patent Document 1] Japanese Unexamined Patent Application No. 2008-116782

SUMMARY OF THE INVENTION

Problem to be Solved by the Invention

A noise canceling headphone including a plurality of microphones arranged on the circumference of an ear cup requires at least four microphones in order to avoid being affected by the direction of a noise source. Otherwise, a sufficient noise-canceling effect cannot be achieved. If the number of the microphones increases, noise entering from various directions can be collected before passing through an ear cup, which eliminates the effect due to the direction of a noise source. Only by the plurality of microphones having the same characteristics, however, can a canceling signal generated in response to a noise signal input from each microphone effectively cancel the noise signal. This is because only a plurality of microphones having the same characteristics and circuits for processing an input noise signal having the same characteristics can adjust the phase of a generated canceling signal. Such a processing circuit has a complicated structure, and therefore requires multiple components and hence high production costs.

Likewise, there is a problem that a noise canceling headphone configured by combining the feed-forward system with the feedback system needs to synthesize a canceling signal generated in response to the noise collected by the external microphone with a canceling signal generated in response to noise components obtained by eliminating a reproduced sound from synthesized sound of the reproduced sound and the noises that are collected by an inner microphone with their phases adjusted to output the synthesized canceling signal, which complicates the processing and the circuit structure.

In view of the problems above, an object of the present invention is to provide a noise canceling headphone that is not affected by the direction from which noise enters without complicating the circuit structure by disposing a sound-wave introducing part of a microphone for collecting sound in a sealed space provided outside a front air chamber.

Means for Solving the Problem

The present invention provides a feed-forward noise canceling headphone of one of an on-ear type and an ear-muff type, in which a noise-canceling signal is generated in response to an external-noise signal generated by a microphone that is attached to a housing, and a headphone unit is driven by the noise-canceling signal to output a canceling sound to a user, including: the housing; and an air chamber that is a space sealed by a member that covers an outer circumference of the housing and is formed outside a front air chamber, wherein a sound-wave introducing part of the microphone is provided in the air chamber.

The present invention relates to the noise canceling headphone, wherein the housing includes a groove that deepens from an outer circumferential surface towards a central direction of the housing, and the air chamber is a space sealed by a member that covers the groove from an outer circumferential side.

The present invention relates to the noise canceling headphone, wherein the air chamber communicates with an external space through a hole formed in a part of a member that covers an outer circumference of the housing.

The present invention relates to the noise canceling headphone, wherein the air chamber is a space sealed by an ear pad that abuts on a user and a cover provided outside the housing.

The present invention relates to the noise canceling headphone, wherein the air chamber acoustically communicates with a space in the ear pad through a hole provided in a wall on an air chamber side of the ear pad that abuts on the user.

The present invention relates to the noise canceling headphone, wherein a maximum linear length in the air chamber is shorter than or equal to a wavelength of external noise to be cancelled.

The present invention relates to the noise canceling headphone, including a circuit that combines a noise-canceling signal and an audio signal to output the combined signal.

Effects of the Invention

According to the present invention, a noise canceling headphone that exerts an equable canceling effect irrespective of a direction of noise can be provided at low cost. According to the present invention, further, a noise canceling headphone can be achieved that can respond to any frequency bands even with the same circuit configuration since a frequency band for exerting the canceling effect can be adjusted by providing a hole in an air chamber so as to communicate with an external space.

BEST MODE(S) FOR CARRYING OUT THE INVENTION

Figure 1:
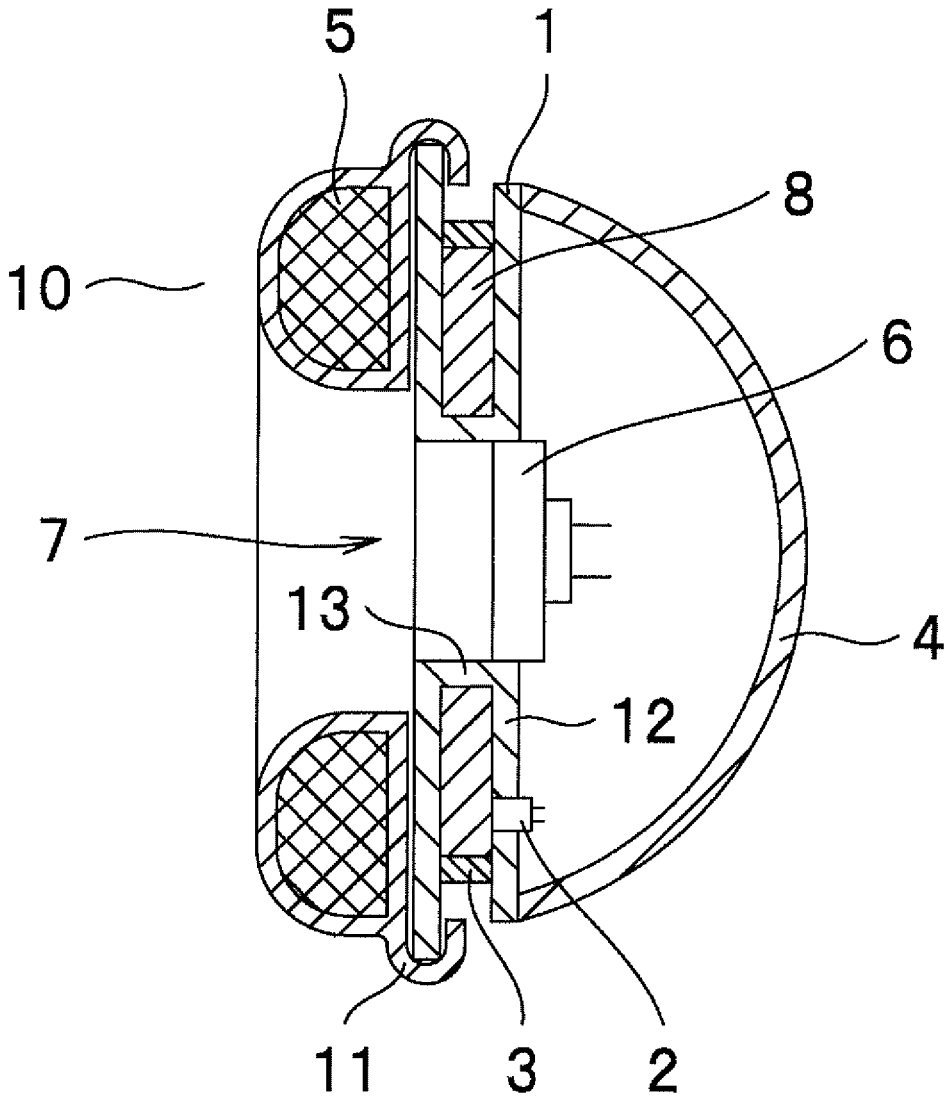
FIG. 1 is a schematic cross-sectional view of a noise canceling headphone according to an embodiment of the present invention.

An embodiment of a noise canceling headphone according to the present invention is explained below with reference to accompanying drawings. FIG. 1 is a schematic cross-sectional view showing only one side of the symmetrical noise canceling headphone. In FIG. 1, a noise canceling headphone 10 includes an ear pad 5 that abuts on the side of a user's head and the circumference of the auricle, a baffle board 1 to which the ear pad 5 is attached so as to configure a part of a housing of the noise canceling headphone 10, a headphone unit 6 that is disposed at the center of the baffle board 1 and has a speaker for outputting a canceling signal and a musical-sound reproduction signal, an ear cup 4 attached to the baffle board 1 so as to cover a back side of the baffle board 1 to form a space accommodating a circuit for noise cancellation processing according to the present invention, a microphone 2 attached to the baffle board 1 to collect external noise, and a sealing plate 3 that seals a space in which a noise introducing part (acoustic terminal) of the microphone 2 is disposed.

The cushioned and toroidal ear pad 5 includes an elastic material such as a sponge and a skin material that covers an outer circumferential surface of the elastic material. The ear pad 5 is fixed to the baffle board 1 by covering the outer circumference of the front surface of the baffle board 1 (left side in FIG. 1) with a part of the skin material. A front air chamber 7 is defined by the ear pad 5, the front surface of the baffle board 1 and the user's external-ear canal.

The baffle board 1 is integrally configured in a state where toroidal discs 11 and 12 having different outer diameters are separated in an axis direction. A part of the skin material provided on the outer circumference of the ear pad 5 covers the outer circumference of the disc 11 that has a larger outer diameter and is disposed on the front surface. The ear cup 4 is disposed on the outer circumference on the outer side of the disc 12 that has a diameter smaller than that of the disc 11 and is placed on the back side. First and second discs 11 and 12 are fixed with a predetermined interval via a cylinder 13 that is disposed in a central hole in the first disc 11 and ascends in an axis direction. The headphone unit 6 having a speaker is disposed in a central hole in the second disc 12.

In a gap interposed between the discs 11 and 12, the sealing plate 3 formed in a ring shape is fitted adjacent to the outer circumferences of the discs 11 and 12. A ring-shaped air chamber 8 is defined by the sealing plate 3, the discs 11 and 12, and the cylinder 13. The size of the sealing plate 3 is defined so that an outer diameter of the air chamber 8 is larger than or equal to that of the front air chamber 7 and an outer circumference of the air chamber 8 is formed on or outer than the circumference of the front air chamber 7. The air chamber 8, therefore, is placed with respect to all directions of the front air chamber 7 and the external noise reaches the air chamber 8 before reaching the front air chamber 7.

The air chamber 8 as a sealed space functions as a pressure (sound pressure) acoustic field with respect to a wavelength longer than a maximum linear length of the air chamber 8 (a frequency lower than a frequency of the wavelength). Sound waves of the external noise that reach the air chamber 8 whose frequency is lower than or equal to the predetermined frequency defined depending on the size of the air chamber 8 are instantly and uniformly transmitted all over the air chamber 8 and collected by the microphone 2 having a sound-wave introducing part disposed in the air chamber 8.

By use of the noise canceling headphone 10 according to the embodiment, since the external noise entering from any direction reaches the air chamber 8 before reaching the front air chamber 7, the external noise from any direction which has the predetermined frequency can be uniformly collected by the microphone 2. This is because the air chamber 8 is configured to function as a pressure (sound pressure) acoustic field. The noise canceling headphone 10 according to the embodiment, thus, uniformly generates the canceling signal irrespective of the direction of the external noise and, therefore, the headphone unit 6 outputs a canceling sound without a delay in reach of the external noise, thereby achieving effective noise cancellation.

The air chamber 8 functions as a pressure (sound pressure) acoustic field with respect to a frequency band having a wavelength longer than a wavelength defined by a capacity and the maximum length of the air chamber 8. Accordingly, the noise canceling headphone that exerts the best cancellation effect corresponding to a frequency characteristic of the external noise can be achieved by adjusting the sizes of the baffle board 1 and the sealing plate 3. For example, if a frequency to be canceled is lower than or equal to 2 kHz, the maximum length of the air chamber 8 only needs to be shorter than or equal to 16.5 cm.

The sound-wave introducing part of the microphone 2 only needs to face the air chamber 8, and the noise canceling headphone according to the present invention is not limited by the position where the sound-wave introducing part is attached.

Furthermore, acoustic characteristics of the microphone 2 can be adjusted by providing a hole that communicates with the external space rather than entirely sealing the air chamber 8. This allows the acoustic characteristics of the noise canceling headphone 10 to be easily adjusted even after mounting the sealing plate 3.

According to the noise canceling headphone having the above-explained structure, a noise canceling headphone that can effectively cancel the external noise generated from all directions with only one microphone for collecting the external noise can be achieved without any complicated processing circuit.

In the noise canceling headphone having the above-explained configuration according to the present invention, since the introducing part of the microphone 2 for collecting the external noise is not directly brought into contact with the external space, the introducing part is not affected by wind (outside air or air from air conditioners) and rain, and also frictional noise generated by the user's hair being brought into contact with the introducing part of the microphone can be eliminated.

Figure 2:
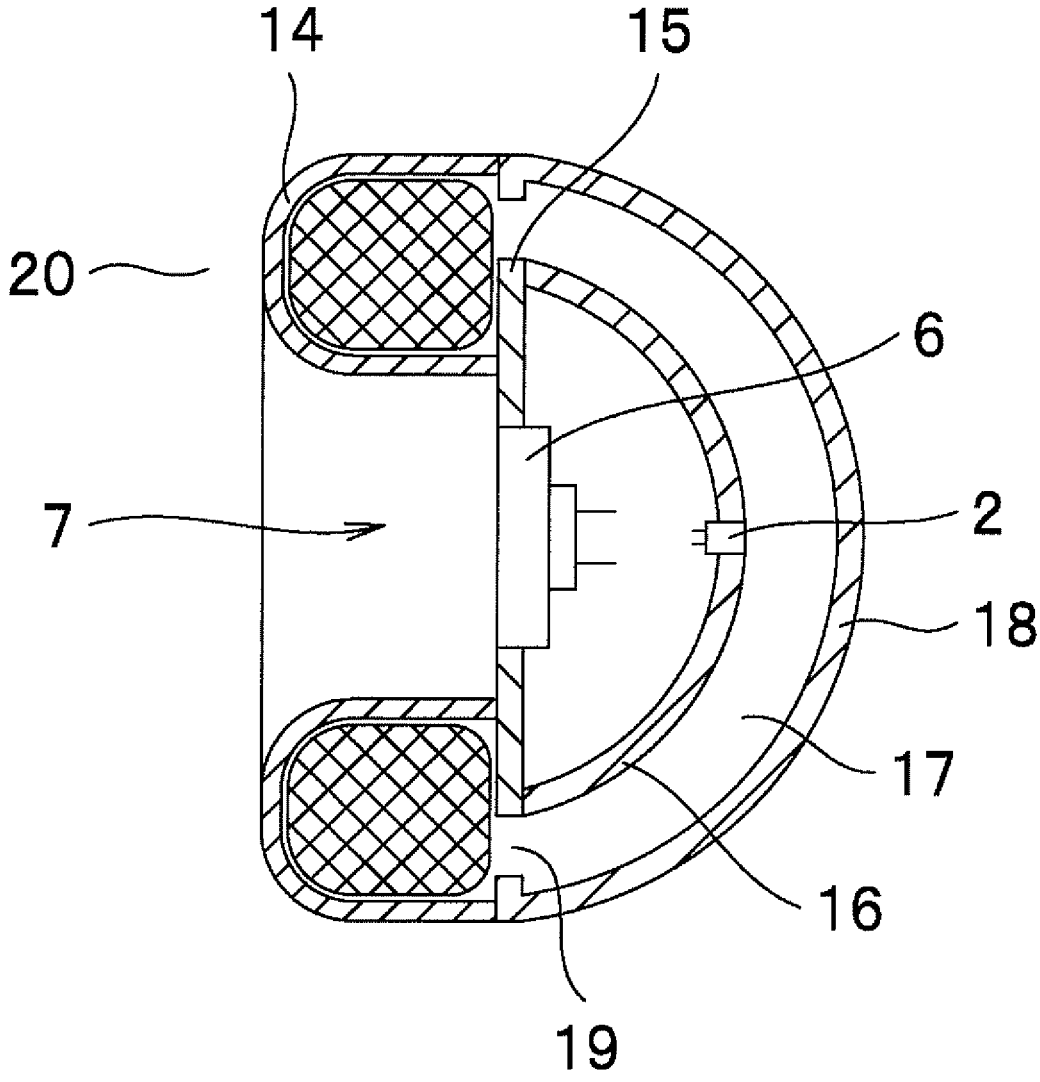
FIG. 2 is a schematic cross-sectional view of the noise canceling headphone according to another embodiment of the present invention.

Next, another embodiment of a noise canceling headphone according to the present invention is explained below with reference to FIG. 2. FIG. 2 is a schematic cross-sectional view showing only one side of the symmetrical noise canceling headphone. In FIG. 2, a noise canceling headphone 20 includes a cushioned and approximately toroidal ear pad 14 that abuts on the side of a user's head and the circumference of the auricle, and accommodates an elastic material therein, a toroidal baffle board 15 to which the ear pad 14 is attached so as to configure a part of a housing of the noise canceling headphone 10, a headphone unit 6 that is disposed at the center of the baffle board 15 and has a speaker for outputting a canceling signal and a sound reproducing signal; an approximately hemispherical ear cup 16 that covers a back side of the baffle board 15 and forms a space accommodating a processing-operation circuit of the noise canceling headphone, a microphone 2 for collecting external noise disposed adjacent to the center of the hemispherical surface of the ear cup 16 with a sound-wave introducing part directed outward; an approximately hemispherical microphone cover 18 that forms an air chamber 17 for shutting off the sound-wave introducing part of the microphone 2 from the external space.

Since the air chamber 17 has an outer diameter that is larger than or equal to that of the front air chamber 7, the external noise that enters the noise canceling headphone 20 reaches the air chamber 17 before reaching the front air chamber 7. The air chamber 17 is a space sealed by the ear pad 14, the ear cup 16 and the microphone cover 18. For the external noise having a wavelength that is longer than or equal to that of a maximum linear length of the air chamber 17, the air chamber 17 functions as a pressure (sound pressure) acoustic field. Accordingly, sound waves of the external noise that reaches the air chamber 17 whose frequency is lower than a predetermined frequency are uniformly transmitted all over the air chamber 17 at the instant of reaching the air chamber 17 from any direction and collected by the microphone 2 in which the sound-wave introducing part is disposed toward the air chamber 17.

According to the noise canceling headphone 20 as configured above, the external noise from any direction can be uniformly collected irrespective of the direction of the external noise without multiple microphones and, therefore, an excellent noise-canceling effect with a simple structure can be achieved.

The frequency of the external noise that can be uniformly collected by the microphone 2 can be varied by providing a through-hole 19 in a part (surface) at which the ear pad 14 comes into contact to the air chamber 17 so as to vary the capacity of the air chamber 17. Furthermore, the external noise entering through the inside of the ear pad 14 can be easily collected. In addition, like the embodiment 1, the acoustic characteristic of the microphone 2 can be adjusted by providing a hole that communicates with the external space rather than entirely sealing the air chamber 17.

The noise canceling headphone 20 explained in the embodiment 2 can exert a more excellent noise canceling effect than that of the noise canceling headphone 10 explained in the embodiment 1 and increase the amount of attenuation of the external noise.

In this specification, "musical signal" refers to a general musical signal and also refers to a so-called audio signal, and is sometimes referred to as a "musical-sound signal".

INDUSTRIAL APPLICABILITY

The present invention can be applied to a noise canceling ear muff that is used under overwhelming noise by removing the musical-sound reproducing function.

EXPLANATIONS OF LETTERS OR NUMERALS

1 baffle board
2 microphone
3 sealing plate
4 ear cup
5 ear pad
6 headphone unit
7 front air chamber
8 air chamber

The invention claimed is:

1. A feed-forward noise canceling headphone of one of an on-ear type and an ear-muff type, comprising:

a front air chamber defined by an ear pad that abuts on a user, an external-ear canal of the user, and a housing;

an air chamber containing empty free space that is a space separate from the housing and the front air chamber, wherein said air chamber is sealed by the housing and a member that covers an outer circumference of the housing, and wherein said air chamber is arranged outside the front air chamber;

a microphone attached to the housing, wherein a sound-wave introducing part of the microphone is provided in the air chamber, and wherein a noise-canceling signal is generated by a circuit in response to an external-noise signal generated by the microphone; and a headphone unit driven by the noise-canceling signal to output a canceling sound to the user, wherein the air chamber functions as a pressure acoustic field such that sound waves of an external noise that reach the air chamber having a wavelength longer than or equal to a maximum linear length of the air chamber are uniformly transmitted all over the air chamber, and wherein the microphone collects the external noise reaching the air chamber before the external noise reaches the front air chamber.

2. The feed-forward noise canceling headphone according to claim 1, wherein the housing comprises a groove that deepens from an outer circumferential surface towards a central direction of the housing, and wherein the member sealing the air chamber covers the groove from an outer circumferential side.

3. The feed-forward noise canceling headphone according to claim 1, wherein the air chamber communicates with an external space through a hole formed in a part of the member that covers an outer circumference of the housing.

4. The feed-forward noise canceling headphone according to claim 1, wherein the air chamber is further sealed by the ear pad that abuts on the user and the member is a cover provided outside the housing.

5. The feed-forward noise canceling headphone according to claim 1, wherein the air chamber acoustically communicates with a space in the ear pad through a hole provided in a wall on an air chamber side of the ear pad that abuts on the user.

6. The feed-forward noise canceling headphone according to claim 1, wherein the maximum linear length in the air chamber is shorter than or equal to a wavelength of external noise to be cancelled.

7. The feed-forward noise canceling headphone according to claim 1, further comprising:

a circuit that combines the noise-canceling signal and an audio signal to output a combined signal.

8. The feed-forward noise canceling headphone according to claim 1, wherein said feed-forward noise canceling headphone cancels the external noise without use of a noise-canceling processing circuit.

9. A feed-forward noise canceling headphone of one of an on-ear type and an ear-muff type, comprising:

a housing comprising a baffle board attached to an ear pad that abuts on a user;

a front air chamber defined by the ear pad that abuts on the user, an external-ear canal of the user, and the housing;

an air chamber containing empty free space that is a space separate from the housing and the front air chamber, wherein said air chamber is sealed by the housing and a member that covers an outer circumference of the housing and said air chamber is arranged outside the front air chamber;

a microphone attached to the housing, wherein a sound-wave introducing part of the microphone is provided in the air chamber, and wherein a noise-canceling signal is generated by a circuit in response to an external-noise signal generated by the microphone; and a headphone unit driven by the noise-canceling signal to output a canceling sound to the user, wherein the headphone unit is disposed in the housing, wherein the air chamber functions as a pressure acoustic field such that sound waves of an external noise that reach the air chamber having a wavelength longer than or equal to a maximum linear length of the air chamber are uniformly transmitted all over the air chamber, and wherein the microphone collects the external noise reaching the air chamber before the external noise reaches the front air chamber.

10. A feed-forward noise canceling headphone of one of an on-ear type and an ear-muff type, comprising:

a housing comprising a baffle board and an ear cup attached to the baffle board so as to cover a backside of the baffle board;

a front air chamber defined by an ear pad that abuts on a user, an external-ear canal of the user, and the housing;

an air chamber containing empty free space that is a space separate from the housing and the front air chamber, wherein said air chamber is sealed by the housing and a member that covers an outer circumference of the housing and said air chamber is arranged outside the front air chamber;

a microphone attached to the housing, wherein a sound-wave introducing part of the microphone is provided in the air chamber, and wherein a noise-canceling signal is generated by a circuit in response to an external-noise signal generated by a microphone; and a headphone unit driven by the noise-canceling signal to output a canceling sound to the user, wherein the headphone unit is disposed in the baffle board, wherein the air chamber functions as a pressure acoustic field such that sound waves of an external noise that reach the air chamber having a wavelength longer than or equal to a maximum linear length of the air chamber are uniformly transmitted all over the air chamber, and wherein the microphone collects the external noise reaching the air chamber before the external noise reaches the front air chamber.

* * * * *